US011355879B2

(12) United States Patent
Qing et al.

(10) Patent No.: US 11,355,879 B2
(45) Date of Patent: Jun. 7, 2022

(54) INTERCONNECTION CONNECTOR AND CONNECTOR ASSEMBLY

(71) Applicant: SUINING LUXSHARE PRECISION INDUSTRY CO., LTD., Suingning (CN)

(72) Inventors: Rui Qing, Suingning (CN); Sheng Wei Su, Suingning (CN); Chun-Tai Lee, Suingning (CN); Hui Hu, Suingning (CN)

(73) Assignee: SUINING LUXSHARE PRECISION INDUSTRY CO., LTD., Suingning (CN)

( * ) Notice: Subject to any disclaimer, the term of this patent is extended or adjusted under 35 U.S.C. 154(b) by 137 days.

(21) Appl. No.: 16/907,596

(22) Filed: Jun. 22, 2020

(65) Prior Publication Data

US 2021/0013650 A1 Jan. 14, 2021

(30) Foreign Application Priority Data

Jul. 12, 2019 (CN) ..... 201921097223.9

(51) Int. Cl.
*H01R 12/77* (2011.01)
*H01R 13/506* (2006.01)

(52) U.S. Cl.
CPC ..... *H01R 12/771* (2013.01); *H01R 13/506* (2013.01)

(58) Field of Classification Search
CPC .... H01R 12/171; H01R 13/506; H01R 13/42; H01R 12/77
See application file for complete search history.

(56) References Cited

U.S. PATENT DOCUMENTS 4,065,199 A * 12/1977 Andre ..... H01B 7/08 439/498
4,834,673 A * 5/1989 Beinhaur ..... H01R 12/675 439/422
7,909,661 B2 * 3/2011 Wu ..... H01R 12/721 439/701
9,647,383 B2 * 5/2017 Lee ..... H01R 13/506
(Continued)

FOREIGN PATENT DOCUMENTS

CN 105846208 A 8/2016

*Primary Examiner* — Jean F Duverne
(74) *Attorney, Agent, or Firm* — Birch, Stewart, Kolasch & Birch, LLP

(57) ABSTRACT

The present application discloses an interconnection connector including an insulative housing and a number of conductive terminals. The insulative housing includes a base portion and a mating portion adapted to mate with a mating connector. Each conductive terminal includes a contact portion positioned in the mating portion and an abutment portion located on the base portion. The contact portions are adapted for being electrically connected to the mating connector, and the abutment portions are adapted for contacting a conductive pad of a flexible flat cable. Besides, a connector assembly including the interconnection connector is also disclosed. The present application simplifies the mating structure by providing the abutment portions on the base portion to contact the conductive pads of the flexible flat cable, thereby easily to achieve electrical connection between the conductive terminals and the flexible flat cable.

20 Claims, 16 Drawing Sheets

(56) References Cited

U.S. PATENT DOCUMENTS

| | | | | |
|---|---|---|---|---|
| 10,727,620 | B2 * | 7/2020 | Vittapalli | H01R 12/598 |
| 2012/0156938 | A1 * | 6/2012 | Zhang | H01R 24/60<br>439/660 |
| 2016/0043510 | A1 * | 2/2016 | Peng | H01R 13/665<br>439/607.01 |

* cited by examiner

INTERCONNECTION CONNECTOR AND CONNECTOR ASSEMBLY

CROSS-REFERENCE TO RELATED APPLICATION

This patent application claims priority of a Chinese Patent Application No. 201921097223.9, filed on Jul. 12, 2019 and titled "Interconnection connector", the entire content of which is incorporated herein by reference.

TECHNICAL FIELD

The present application relates to an interconnection connector and a connector assembly, which can be applied in thinner electronic products, such as notebook computers.

BACKGROUND

In thinner existing electronic products such as notebook computers, a camera is connected to a controller through a connector. The connector usually includes an insulative housing, a plurality of conductive terminals disposed in the insulative housing, and a plurality of wires electrically connected to the conductive terminals. When the wire is pressed against the conductive terminal, the puncture structure on the conductive terminal rivets or punctures the wire, so that the conductive part of the puncture structure directly contacts the conductive core of the wire, thereby achieving an electrical connection therebetween.

However, since electronic products are becoming thinner and thinner, due to the thickness, the existing wire routing cannot be applied under a display screen, and the manufacturing efficiency of existing way of connection is generally low because it requires one end of the wire welded to a flexible flat cable, the other end of the wire connected to the conductive terminal by riveting or puncture, and other processes of appropriate treatment of connector appearance.

SUMMARY

The present application discloses an interconnection connector including an insulative housing and a plurality of conductive terminals disposed in the insulative housing. The insulative housing includes a base portion and a mating portion protruding from the base portion. The mating portion is adapted to mate with a mating connector. Each conductive terminal includes a contact portion positioned in the mating portion and an abutment portion located on the base portion. The contact portions are adapted for being electrically connected to the mating connector, and the abutment portions are adapted for contacting a conductive pad of a flexible flat cable.

Besides, the present application discloses a connector assembly including the interconnection connector, the flexible flat cable electrically connected to one end of the interconnection connector, and the mating connector electrically connected to the other end of the interconnection connector.

Compared with the prior art, the present application simplifies the mating structure by providing the abutment portions on the base portion to contact the conductive pads of the flexible flat cable, thereby easily to achieve electrical connection between the conductive terminals and the flexible flat cable.

DETAILED DESCRIPTION

Figure 1:
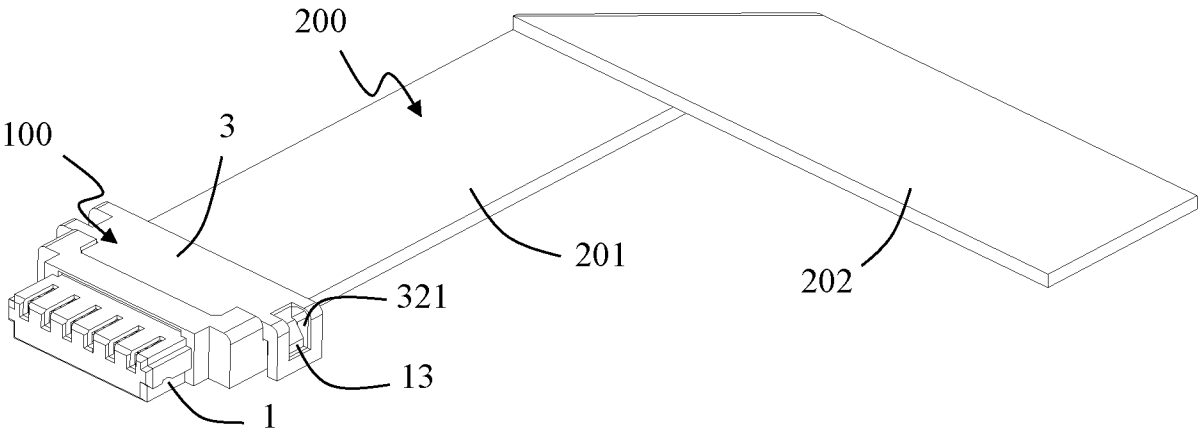
FIG. 1 is a schematic perspective view of an interconnection connector in an embodiment of the present application when it is connected to a flexible flat cable.
Figure 2:
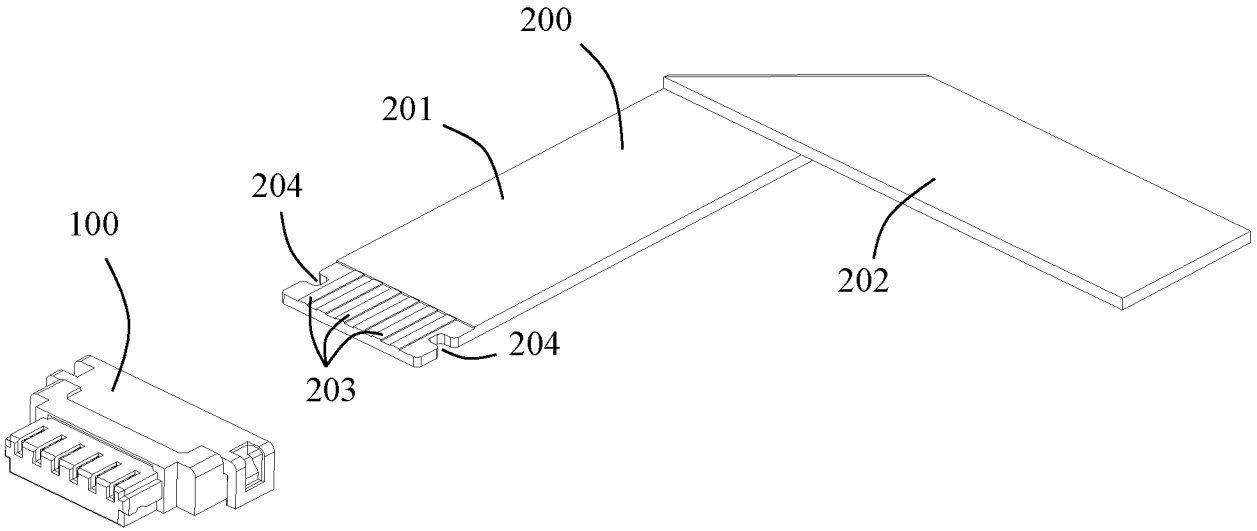
FIG. 2 is an exploded view of FIG. 1 with the flexible flat cable disconnected from the interconnection connector.
Figure 3:
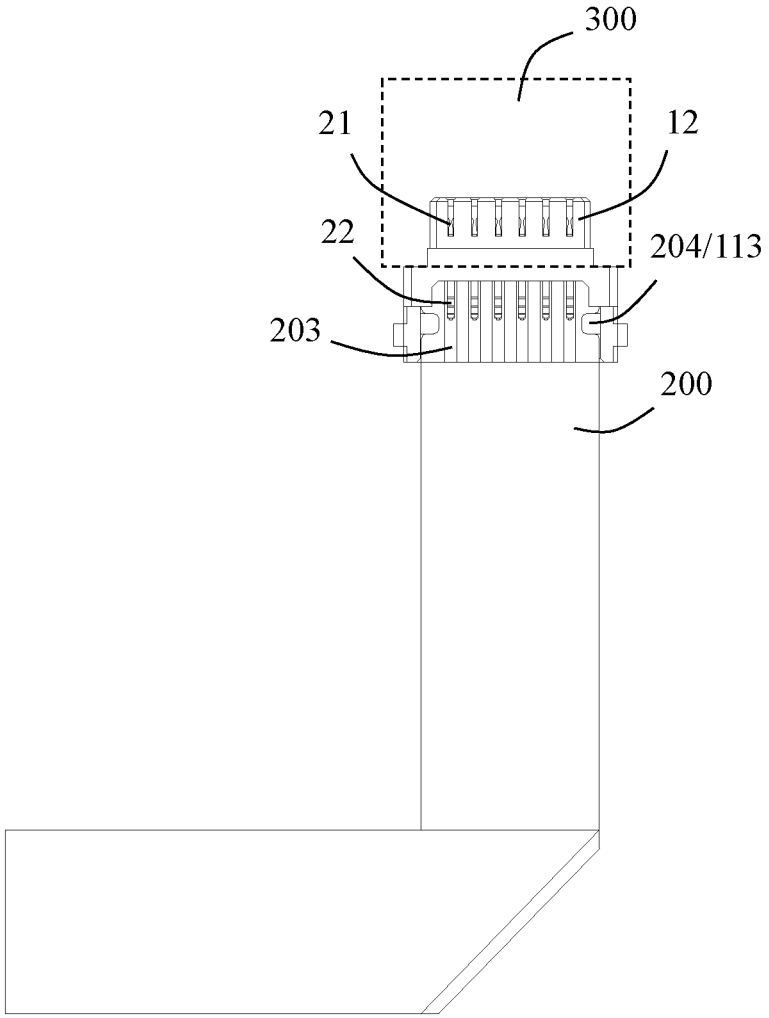
FIG. 3 is a top view of the interconnection connector with a cover removed from FIG. 1.
Figure 4:
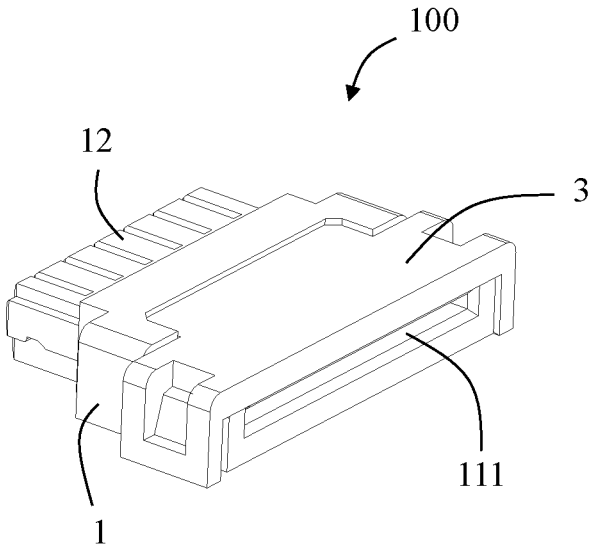
FIG. 4 is a schematic perspective view of the interconnection connector.

Referring to FIGS. 1 to 16, embodiments of the present application disclose two types of interconnection connectors 100 which can be applied in thinner electronic devices (such as notebook computers) to connect a camera to a controller (such as a motherboard). In two embodiments illustrated in the present application, the same reference numerals refer to the same or similar elements. As shown in FIG. 3, the present application discloses a connector assembly including the interconnection connectors 100, a flexible flat cable 200 and a mating connector 300. One end of the interconnection connector 100 is adapted to contact the flexible flat cable 200, and the other end is adapted to electrically connect the mating connector 300. In one of possible applications, the flexible flat cable 200 is located on the back of a display screen and is connected to the motherboard, and the mating connector 300 is connected to the camera. In the illustrated embodiment of the present application, the flexible flat cable 200 includes a first extension 201, a second extension 202 electrically connected to the first extension 201, and a plurality of conductive pads 203 located on the first extension 201. The first extension 201 and the second extension 202 may be at a certain angle (for example, 90 degrees) with each other according to different applications. The first extension 201 and the second extension 202 may be two parts connected with each other, or two parts formed by bending a single flexible flat cable. Preferably, as shown in FIG. 2, the flexible flat cable 200 includes two recesses 204 on lateral sides of the conductive pads 203.

Figure 5:
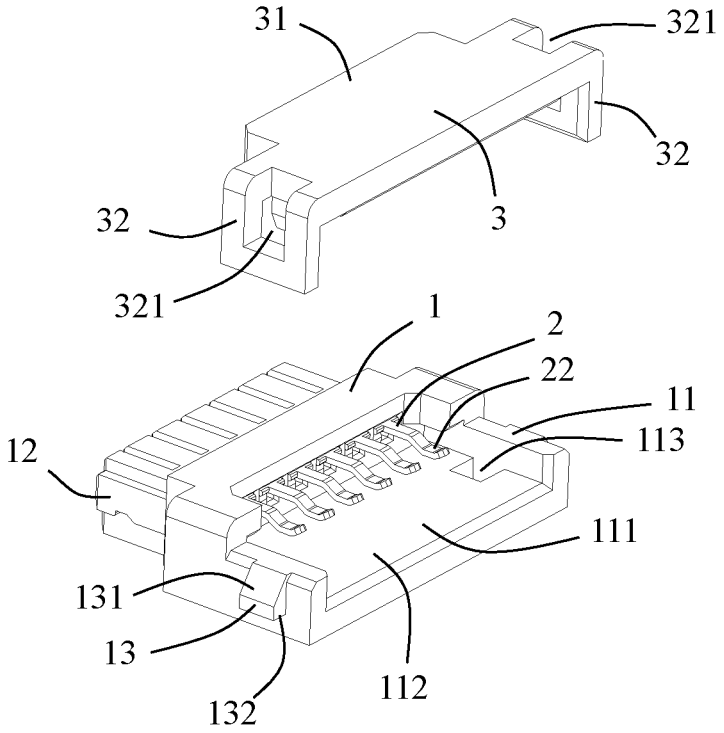
FIG. 5 is a partially exploded perspective view of FIG. 4.
Figure 6:
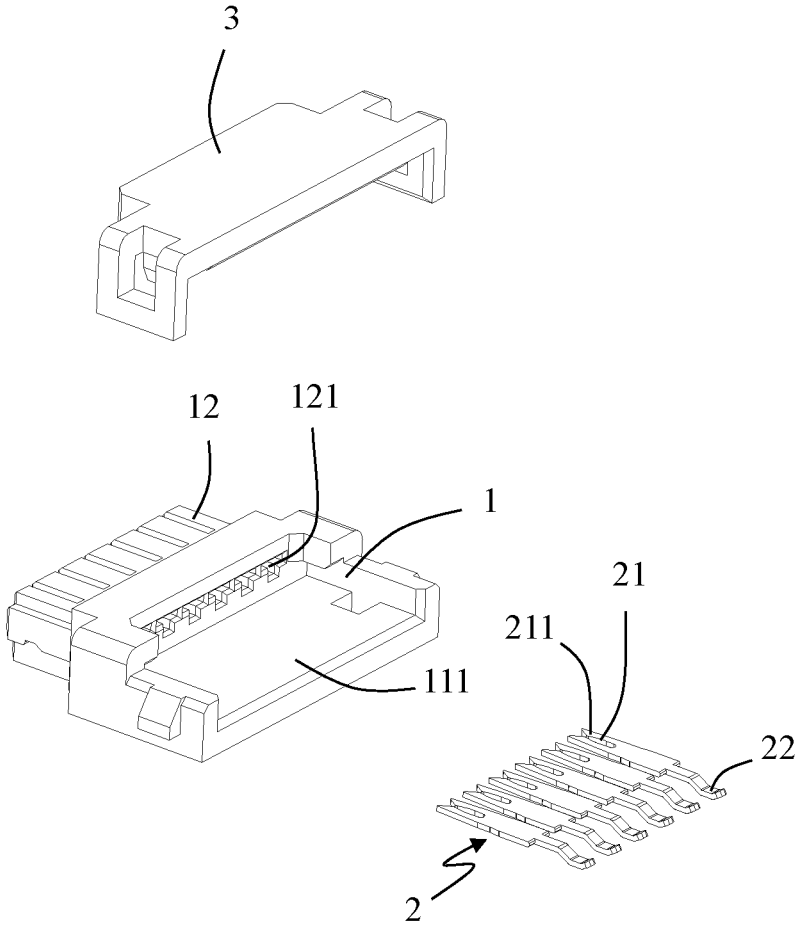
FIG. 6 is a further exploded perspective view of FIG. 5.
Figure 7:
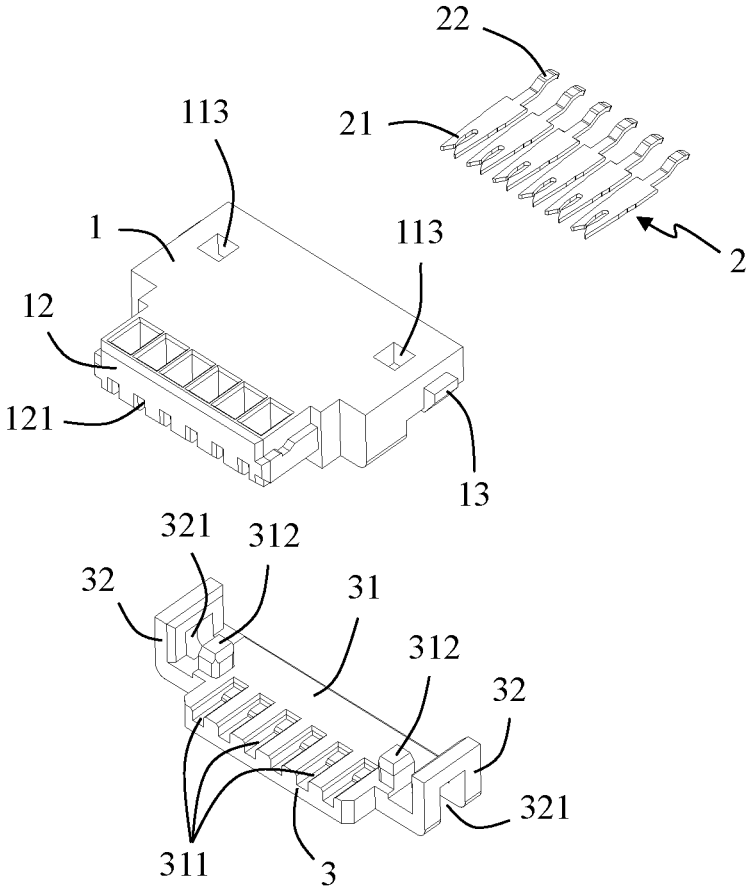
FIG. 7 is an exploded perspective view of FIG. 6 while taking from another direction.

Referring to FIGS. 5 to 7, the interconnection connector 100 includes an insulative housing 1, a plurality of conductive terminals 2 disposed in the insulative housing 1, and a cover 3 mounted to the insulative housing 1. The insulative housing 1 includes a base portion 11 and a mating portion 12 protruding from the base portion 11. The mating portion 12 is adapted to mate with the mating connector 300. The mating portion 12 defines a plurality of terminal receiving grooves 121 for receiving the conductive terminals 2. The base portion 11 defines a receiving space 111 for receiving at least part of the flexible flat cable 200 and a supporting surface 112 for supporting the flexible flat cable 200. The terminal receiving grooves 121 extend backwardly through the base portion 11 to be in communication with the receiving space 111. In addition, the insulative housing 1 is provided with two protrusions 13 on both sides thereof for being fixed to the cover 3. In the illustrated embodiment of the present application, the two protrusions 13 are located on both sides of the base portion 11. Each protrusion 13 includes a guiding surface 131 for guiding the cover 3 when it is assembled to the insulative housing 1, and a locking surface 132 for locking the cover 3 in a locking position.

Each conductive terminal 2 includes a contact portion 21 located in the mating portion 12 for being electrically connected to the mating connector 300, and an abutment portion 22 located on the base portion 11 and configured to be in contact with corresponding conductive pad 203 of the flexible flat cable 200. Referring to FIGS. 5 to 8, in the illustrated embodiment of the present application, the conductive terminals 2 are arranged side by side along a width direction M-M of the insulative housing 1. The conductive terminals 2 are symmetrically arranged along a center line C-C which is perpendicular to the width direction M-M. In the illustrated embodiment of the present application, the conductive terminals 2 are assembled into the corresponding terminal receiving grooves 121 along a front-to-back direction for fixation. Of course, in other embodiments, the conductive terminals 2 may be insert-molded with the insulative housing 1. In the illustrated embodiment of the present application, each abutment portion 22 extends into the receiving space 111 in a cantilevered manner. A space is formed between the abutment portions 22 and the support surface 112 so as to facilitate insertion of the flexible flat cable 200.

Figure 8:
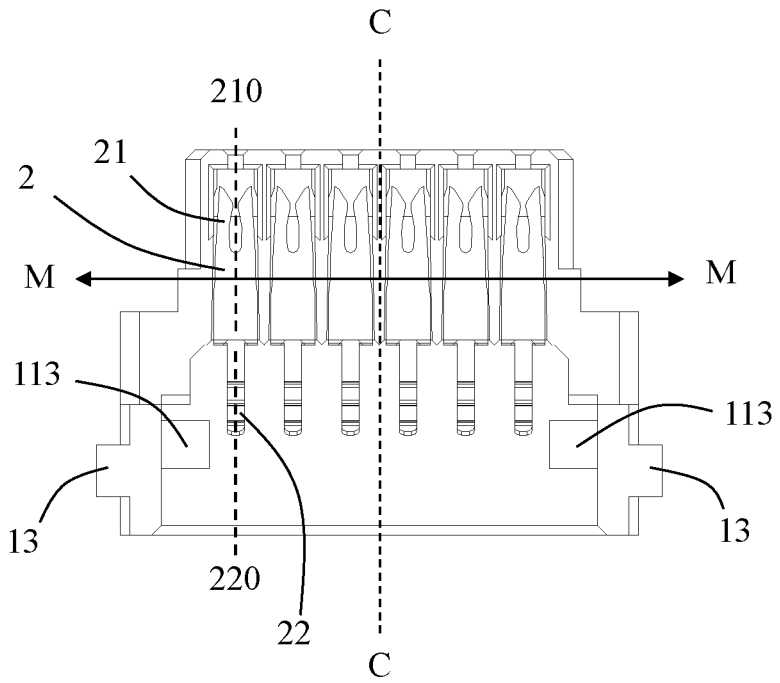
FIG. 8 is a top view of the interconnection connector shown in FIG. 4 with the cover and a part of the insulative housing removed.
Figure 9:
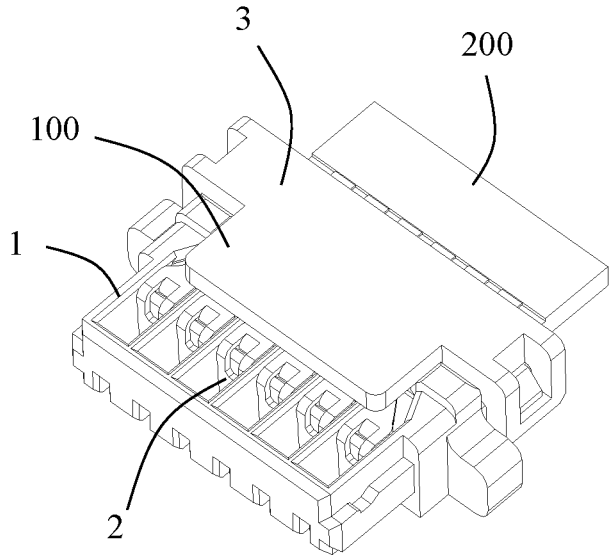
FIG. 9 is a schematic perspective view of the interconnection connector in another embodiment of the present application when it is connected to a flexible flat cable.
Figure 10:
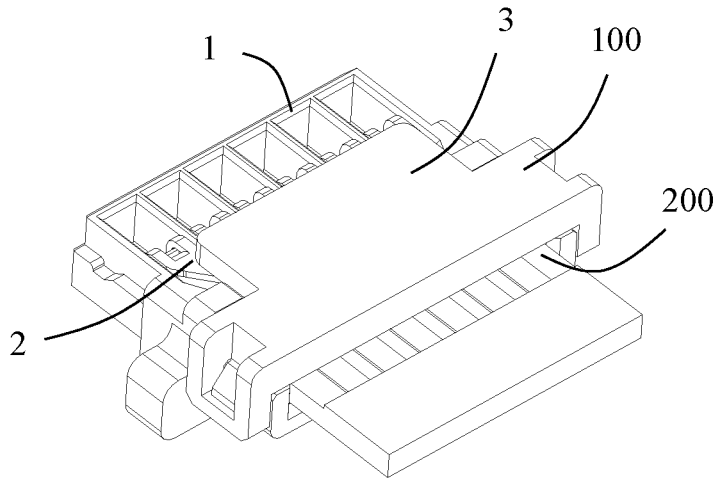
FIG. 10 is a schematic perspective view of FIG. 9 while taking from another angle.
Figure 11:
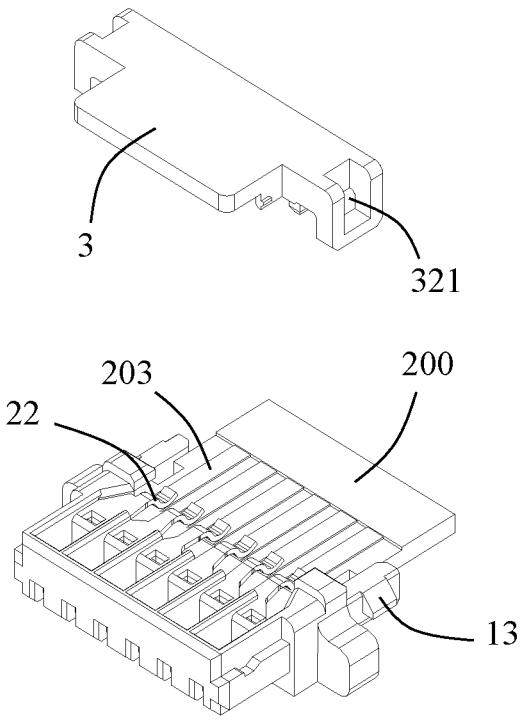
FIG. 11 is a partially exploded perspective view of FIG. 9.
Figure 12:
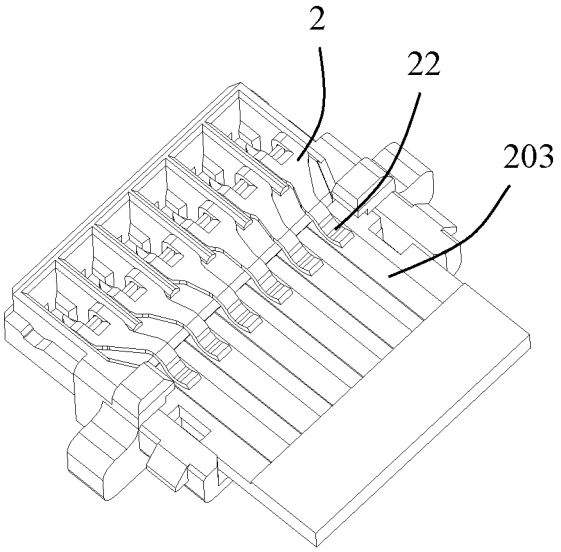
FIG. 12 is another schematic perspective view of the interconnection connector with the cover as shown in FIG. 11 removed.

Referring to FIG. 8, in an embodiment of the present application, for the same conductive terminal 2, a center line 210 of the contact portion 21 is aligned with a center line 220 of the abutment portion 22. In this way, on one hand, it is convenient to manufacture the conductive terminals 2, and on the other hand, the conductive terminals 2 can be adapted to a flexible flat cable 200 which has a slightly larger width.

Referring to FIGS. 9 to 16, in another embodiment of the present application, for the same conductive terminal 2, the center line 210 of the contact portion 21 is offset from the center line 220 of the abutment portion 22. A distance D2 between two center lines 220 of the two outermost abutment portions 22 is smaller than a distance D1 between two center lines 210 of the two outermost contact portions 21. In other words, compared to the contact portions 21, the abutment portions 22 of the conductive terminals 2 are biased toward the center line C-C, thereby reducing the entire width occupied by the abutment portions 22. As a result, the abutment portions 22 can be fit to a flexible flat cable 200 which has a smaller width. It can be understood that the arrangement of the contact portions 21 of the conductive terminals 2 can be adjusted according to the terminal arrangement of the mating connector 300 so that the two connectors can match with each other. Similarly, the arrangement of the abutment portions 22 of the conductive terminals 2 can also be adjustable according to the arrangement of the conductive pads 203 so that they can match with each other as well.

Figure 13:
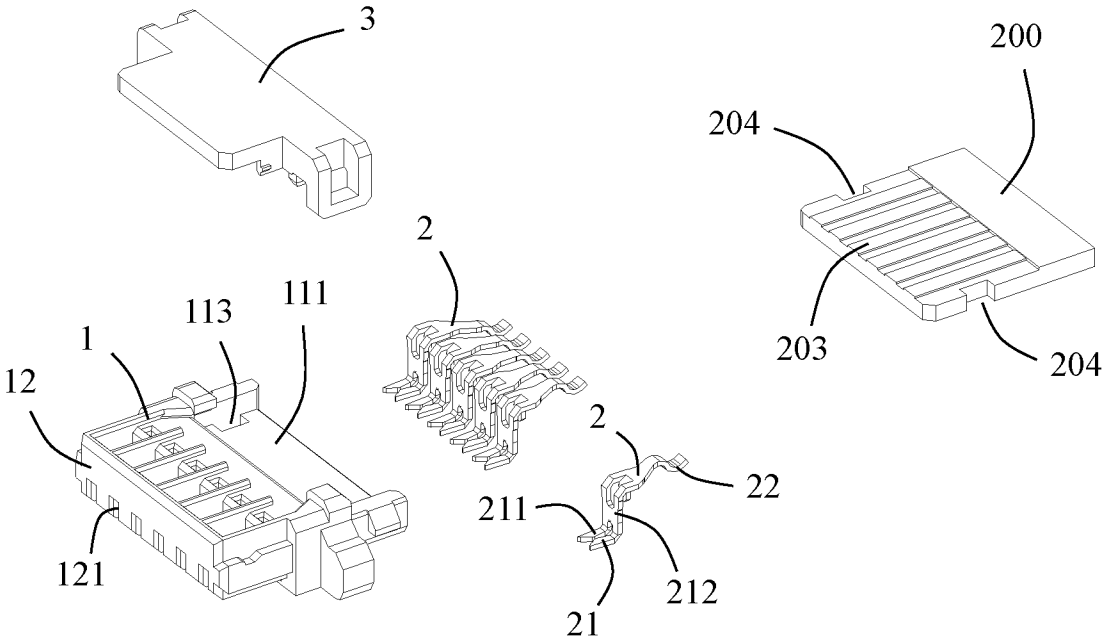
FIG. 13 is a further exploded perspective view of FIG. 11.
Figure 14:
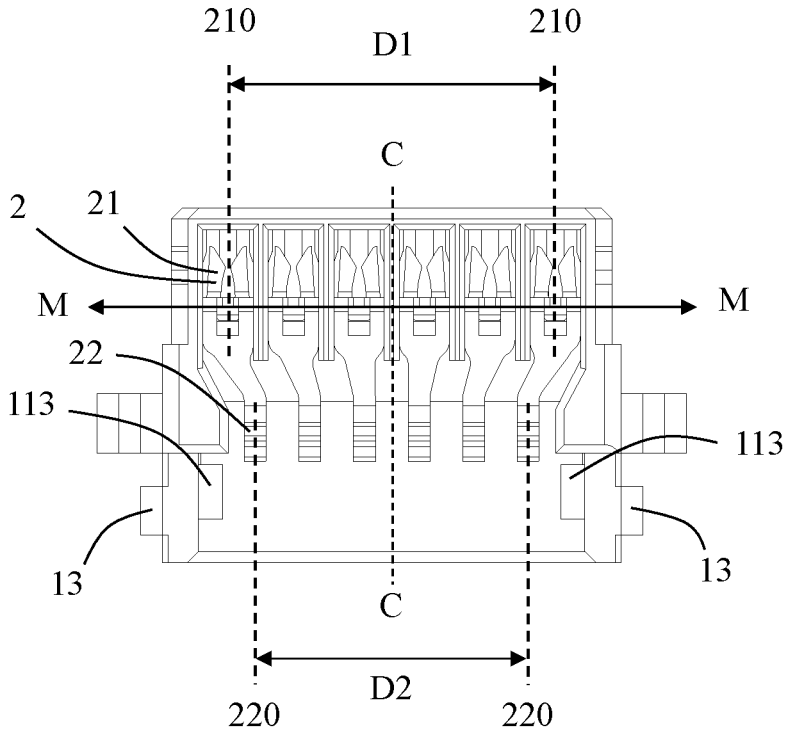
FIG. 14 is a top view of the interconnection connector with the flexible flat cable in FIG. 12 removed.
Figure 15:
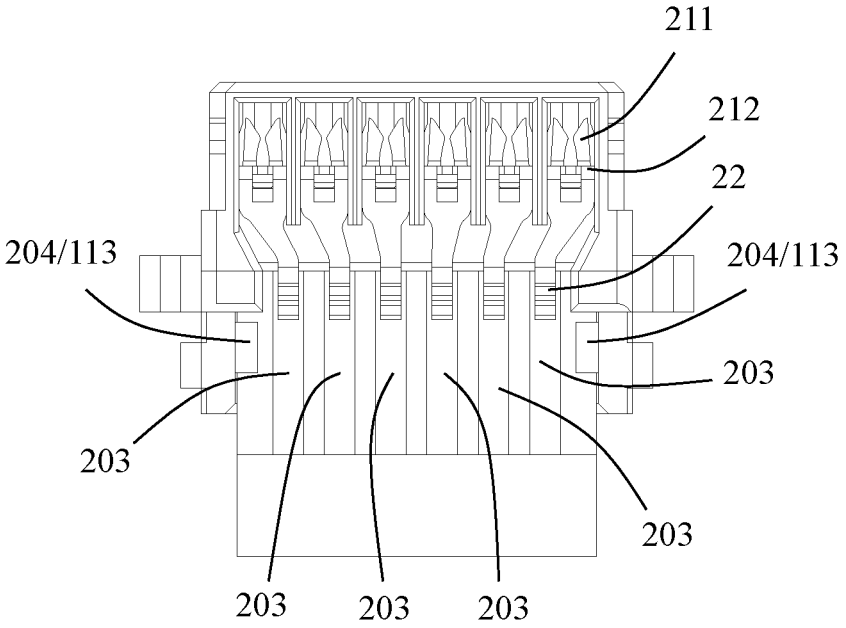
FIG. 15 is a top view of FIG. 12.

Referring to FIGS. 6 and 13, in the illustrated embodiment of the present application, each contact portion 21 is provided with a fork-shaped portion 211. In general, the contact portion 21 is of a flat shape or includes a bent portion 212 along a vertical direction. By providing the bent portions 212, the contact portions 21 and the abutment portions 22 can be located at different heights, and thus the conductive terminals 2 can be adapted to different installation heights of the flexible flat cable 200. It can be understood that structural design of the contact portions 21 can be flexibly adjusted according to installation manners with the insulative housing 1 and cooperation manners with the mating connector 300, of which detailed description is omitted herein.

The cover 3 is mounted on the insulative housing 1 to cover the receiving space 111. In the illustrated embodiment of the present application, the cover 3 includes a cover plate 31 and two side walls 32 extending downwardly from two sides of the cover plate 31, respectively. An inner surface of the cover plate 31 is provided with a plurality of yielding grooves 311 corresponding to the abutment portions 22, which can reduce the thickness of the interconnection connector 100 on one hand, and can protect the abutment portions 22 on the other hand.

Figure 16:
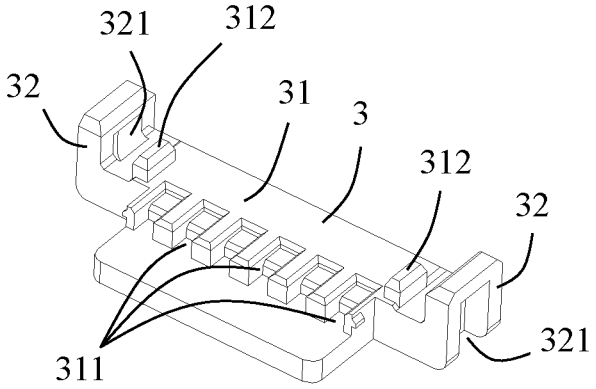
FIG. 16 is a schematic perspective view of the cover as shown in FIG. 11.

In addition, the cover 3 and the insulative housing 1 are further provided with a positioning post 312 and a positioning groove 113 that cooperate with each other. Referring to FIGS. 7 and 16, in the illustrated embodiment of the present application, the positioning post 312 is disposed on the cover plate 31 of the cover 3, and the positioning groove 113 is disposed on the insulative housing 1 and is located in the receiving space 111. When the flexible flat cable 200 is inserted in place, the recesses 204 at least partially overlap the corresponding positioning grooves 113. The positioning posts 312 are then inserted into the overlap portions of the recesses 204 and the positioning grooves 113 for positioning. At the same time, the flexible flat cable 200 can also be prevented from detaching from the insulative housing 1 to avoid connection failure. Besides, in order to fix the cover 3, each side wall 32 of the cover 3 further defines a slot 321 that cooperates with the corresponding protrusion 13. Of course, in other embodiments, the cover 3 may also be configured to be able to pivot relative to the insulative housing 1. When the flexible flat cable 200 needs to be inserted, the cover 3 is opened. When the flexible flat cable 200 is inserted in place, the cover 3 is then closed, and the flexible flat cable 200 gets locked, for example, by the aforementioned protrusions 13 and the slots 321. Preferably, the cover plate 31 of the cover 3 is capable of pressing the flexible flat cable 200 to achieve a certain degree of compression. Preferably, glue can also be dispensed in the space between the cover 3 and the flexible flat cable 200 so as to better improve bonding strength therebetween.

Compared with the prior art, the present application provides the abutment portions 22 on the base portion 11 to be in contact with the conductive pads 203 of the flexible flat cable 200, which not only simplifies the matching structure of the interconnection connector 100 and the flexible flat cable 200, but also is easy to realize the electrical connection thereof. The conductive terminals 2 of the present application is used to connect the terminals of the mating connector 300 with the conductive pads 203 of the flexible flat cable 200 in series, which simplifies system design to some extent.

The above embodiments are only used to illustrate the present application and not to limit the technical solutions described in the present application. The understanding of this specification should be based on those skilled in the art. Descriptions of directions, such as "front", "back", "left", "right", "top" and "bottom", although they have been described in detail in the above-mentioned embodiments of the present application, those skilled in the art should understand that modifications or equivalent substitutions can still be made to the application, and all technical solutions and improvements that do not depart from the spirit and scope of the application should be covered by the claims of the application.

What is claimed is:

1. An interconnection connector comprising:

an insulative housing comprising a base portion and a mating portion protruding from the base portion, the mating portion being adapted to mate with a mating connector; and a plurality of conductive terminals disposed in the insulative housing, each conductive terminal comprising a contact portion positioned in the mating portion and adapted for being electrically connected to the mating connector, and an abutment portion located on the base portion and adapted for contacting a flat conductive pad of a flexible flat cable;

wherein the base portion defines a receiving space to receive at least a part of the flexible flat cable and a supporting surface to support the flexible flat cable; the abutment portion extends into the receiving space in a cantilevered manner; and the flexible flat cable is positioned between the support surface and the abutment portion.

2. The interconnection connector according to claim 1, wherein the conductive terminals are side-by-side arranged along a width direction of the insulative housing, and the conductive terminals are symmetrically arranged along a center line perpendicular to the width direction.

3. The interconnection connector according to claim 1, wherein the conductive terminals are side-by-side arranged along a width direction of the insulative housing; and wherein for the same conductive terminal, a center line of the contact portion is aligned with a center line of the abutment portion.

4. The interconnection connector according to claim 1, wherein the conductive terminals are side-by-side arranged along a width direction of the insulative housing; wherein for the same conductive terminal, a center line of the contact portion is offset from a center line of the abutment portion; and wherein a distance between two center lines of the two outermost abutment portions is smaller than a distance between two center lines of the two outermost contact portions.

5. The interconnection connector according to claim 1, wherein the contact portion is of a flat shape or comprises a bent portion bent along a vertical direction.

6. The interconnection connector according to claim 1, wherein the abutment portion has elasticity to be in contact with the flat conductive pad of the flexible flat cable.

7. The interconnection connector according to claim 1, further comprising a cover mounted on the insulative housing, the cover being provided with a positioning post, the insulative housing being provided with a positioning groove, and the flexible flat cable being provided with a recess; wherein the positioning groove and the recess at least partially overlap with each other, and the positioning post is inserted in the positioning groove and the recess so as to prevent the flexible flat cable from falling out of the receiving space.

8. The interconnection connector according to claim 7, wherein the flexible flat cable is partially inserted into the receiving space.

9. The interconnection connector according to claim 7, wherein an inner surface of the cover defines a plurality of yielding grooves corresponding to the abutment portions.

10. The interconnection connector according to claim 1, wherein the insulative housing is provided with protrusions on both sides; the interconnection connector further comprises a cover mounted on the insulative housing and covering the receiving space, and the cover is provided with slots in mating with the protrusions.

11. A connector assembly comprising:

an interconnection connector;

a flexible flat cable electrically connected to one end of the interconnection connector, the flexible flat cable being provided with a plurality of flat conductive pads; and a mating connector electrically connected to the other end of the interconnection connector;

the interconnection connector comprising:

an insulative housing comprising a base portion and a mating portion extending from the base portion, the mating portion being inserted into the mating connector, the base portion comprising a receiving space; and a plurality of conductive terminals disposed in the insulative housing, each conductive terminal comprising a contact portion positioned in the mating portion to electrically contact the mating connector, and an elastic abutment portion extending into the receiving space in a cantilevered manner to contact a corresponding flat conductive pad of the flexible flat cable.

12. The connector assembly according to claim 11, wherein the conductive terminals are side-by-side arranged along a width direction of the insulative housing, and the conductive terminals are symmetrically arranged along a center line perpendicular to the width direction.

13. The connector assembly according to claim 11, wherein the conductive terminals are side-by-side arranged along a width direction of the insulative housing; and wherein for the same conductive terminal, a center line of the contact portion is aligned with a center line of the abutment portion.

14. The connector assembly according to claim 11, wherein the conductive terminals are side-by-side arranged along a width direction of the insulative housing; wherein for the same conductive terminal, a center line of the contact portion is offset from a center line of the abutment portion; and wherein a distance between two center lines of the two outermost abutment portions is smaller than a distance between two center lines of the two outermost contact portions.

15. The connector assembly according to claim 11, wherein the contact portion is of a flat shape or comprises a bent portion bent along a vertical direction.

16. The connector assembly according to claim 11, wherein the base portion comprises a supporting surface at the bottom of the receiving space to support the flexible flat cable when the flexible flat cable is partially received in the receiving space.

17. The connector assembly according to claim 16, further comprising a cover mounted to the base portion, the receiving space being formed between an inner surface of the cover and the supporting surface of the base portion.

18. The connector assembly according to claim 17, wherein the inner surface of the cover defines a plurality of yielding grooves corresponding to the abutment portions.

19. The connector assembly according to claim 17, wherein the cover comprises a positioning post, the insulative housing comprises a positioning groove located in the receiving space, and the flexible flat cable comprises a recess at least partially overlapping the positioning groove; wherein the positioning post is inserted into the recess and the positioning groove to prevent the flexible flat cable from detaching from the insulative housing.

20. The connector assembly according to claim 17, wherein the insulative housing is provided with protrusions on both sides, and the cover is provided with slots in mating with the protrusions.

* * * * *